US005127476A

United States Patent [19]

Dickson et al.

[11] Patent Number: 5,127,476

[45] Date of Patent: Jul. 7, 1992

[54] LOCKOUT HOUSING AND SLEEVE FOR SAFETY VALVE

[75] Inventors: Rennie L. Dickson, Carrollton; Glenn R. Davis, Euless, both of Tex.

[73] Assignee: Jerry L. Wilson

[21] Appl. No.: 698,463

[22] Filed: May 10, 1991

[51] Int. Cl.[5] ..... E21B 34/14

[52] U.S. Cl. ..... 166/323; 166/317; 166/322; 166/332

[58] Field of Search ..... 166/323, 332, 321, 322, 166/317

[56] References Cited

U.S. PATENT DOCUMENTS

| | | | |
|---|---|---|---|
| 3,786,866 | 1/1974 | Tausch et al. | 166/323 X |
| 3,799,258 | 3/1974 | Tausch | 166/323 X |
| 3,882,935 | 5/1975 | Calhoun | 166/322 |
| 4,077,473 | 3/1978 | Watkins | 166/323 |
| 4,460,046 | 7/1984 | Pringle | 166/317 |
| 4,603,740 | 8/1986 | Edwards et al. | 166/323 X |
| 4,624,315 | 11/1986 | Dickson et al. | 166/323 |
| 4,723,606 | 2/1988 | Vinzant et al. | 166/319 |
| 4,749,043 | 6/1988 | Rodenberger | 166/321 |
| 4,945,993 | 8/1990 | Dickson et al. | 166/321 |

*Primary Examiner*—Hoang C. Dang

[57] ABSTRACT

An improved lockout housing (48) and lockout sleeve (46) for a tubing retrievable safety valve (36) having cooperating lugs and lug recesses that are adapted to reduce the likelihood of premature shearing or leaking. Sets of circumferentially spaced, shearable retaining lugs (64) are alternated with sets of circumferentially spaced, shearable communicating lugs (54) that extend radially inward around the upper portion of lockout housing (48) and are preferably unitarily formed as an integral part of the lockout housing (48). First and second sets of longitudinally extending slots (62, 66) are likewise circumferentially spaced around the lower end of outside wall (68) of lockout sleeve (46), and are adapted to slidably engage the longitudinally aligned lugs (54, 64) of the lockout housing. Slots (62) aligned longitudinally with communicating lugs (54) are preferably longer than slots (66) aligned with the retaining lugs (64), and extend a greater distance up outside wall (68) of lockout sleeve (46). Retaining lugs (64) of lockout housing (48) retain lockout sleeve (46) in its upper position relative to lockout housing (48), and shoulders (56) of slots (62) aligned with communicating lugs (54) do not contact communicating lugs (54) of lockout housing (48) until retaining lugs (64) are sheared.

16 Claims, 2 Drawing Sheets

LOCKOUT HOUSING AND SLEEVE FOR SAFETY VALVE

BACKGROUND OF THE INVENTION

1. Field of the Invention

This invention relates to surface controlled subsurface safety valves used in the oil and gas industry, and more particularly, to a lockout housing and sleeve for a tubing retrievable safety valve.

2. Description of Related Art

It is common practice to complete oil and gas producing wells with systems including a subsurface safety valve controlled from the well surface to shut off fluid flow in the well tubing string. Such a valve is generally controlled in response to control fluid pressure conducted to the valve from a remote location at the well surface via a small diameter conduit, permitting the well to be selectively shut in as well conditions require.

Conventional surface controlled subsurface safety valves have previously been disclosed, for example, in U.S. Pat. Nos. 4,723,606 and 4,945,993. As shown in FIG. 2A of U.S. Pat. No. 4,723,606, such valves have previously utilized a lockout sleeve, and threaded knockout plugs to hold the lockout sleeve in its inactive position during normal operation of the safety valve. If the safety valve becomes inoperative, the lockout sleeve can be forced downward to open the valve. Downward movement of the lockout sleeve causes the threaded plugs to shear, establishing hydraulic fluid communication from the control line through the orifice in the portion of each sheared plug that remains threadedly engaged with the lockout housing.

During use of surface controlled subsurface safety valves comprising conventional lockout sleeves and housings, fluid leaks sometimes develop around the threaded shear plugs, especially when the plugs are subjected to repeated hitting that can cause them to crack or fail prematurely.

SUMMARY OF THE INVENTION

According to the present invention, an improved lockout housing and lockout sleeve are provided that respectively comprise cooperating lugs and lug recesses adapted to reduce the likelihood of premature shearing or leaking. According to a preferred embodiment of the invention, a plurality of circumferentially spaced shearable lugs extend radially inward around the upper portion of the lockout housing. The lugs are preferably unitarily formed as an integral part of the lockout housing.

A set of circumferentially spaced, shearable retaining lugs are each preferably solid, and are adapted to retain the lockout sleeve in its inactive position until such time as it is desired to shear the lugs and permit the lockout sleeve to slide downwardly into the lockout housing. A set of circumferentially spaced, shearable communicating lugs each preferably comprises a small hole that is bored radially inward through the outside wall of the lockout housing to a point just short of the inwardly extending end of each lug. These small diameter transverse bores are adapted to provide a path for hydraulic communication between the control line and the annulus between the lockout housing and lockout sleeve when the communicating lugs are sheared. According to a particularly preferred embodiment of the invention, the sets of retaining lugs and communicating lugs each comprise diametrically opposed pairs of lugs, with the retaining lugs being staggered circumferentially from the communicating lugs.

According to a preferred embodiment of the invention, first and second sets of longitudinally extending slots are likewise circumferentially spaced around the lower end of the outside wall of the lockout sleeve. One set of slots preferably comprises diametrically opposed pairs of slots aligned longitudinally with the retaining lugs of the lockout housing. The second set of slots preferably comprises diametrically opposed pairs of slots aligned longitudinally with the communicating lugs of the lockout housing. The longitudinally extending slots of the lockout sleeve are adapted to slidably engage the corresponding lugs of the lockout housing. The slots aligned longitudinally with the communicating lugs are preferably longer than the slots aligned with the retaining lugs, and extend a greater distance up the outside wall of the lockout sleeve. Because of this, the solid retaining lugs of the lockout housing support the lockout sleeve in its upper position relative to the lockout housing, and the top end walls of the slots aligned with the communicating lugs do not contact the communicating lugs of the lockout housing until the retaining lugs are sheared. Once the retaining lugs are sheared, however, the lockout sleeve drops further down, and the top end walls of the slots aligned with the communicating lugs also shear the communicating lugs.

According to a preferred embodiment of the invention, means are provided for trapping the sheared lug portions in the longitudinally extending slots of the lockout sleeve. A particularly preferred means for trapping the sheared lug portions is a snap ring disposed below the lugs in an annular recess in the outside wall of the lockout sleeve.

The lockout sleeve and housing disclosed herein reduce the likelihood of prematurely shearing the lugs having the communicating holes, and also eliminate leak paths such as have been experienced with the use of conventional threaded shear plugs.

BRIEF DESCRIPTION OF THE DRAWINGS

The apparatus of the invention is further described and explained in relation to the following figures of the drawings wherein.

Like reference numerals are used to indicate like parts in all figures of the drawings.

DESCRIPTION OF THE PREFERRED EMBODIMENT

Figure 1:
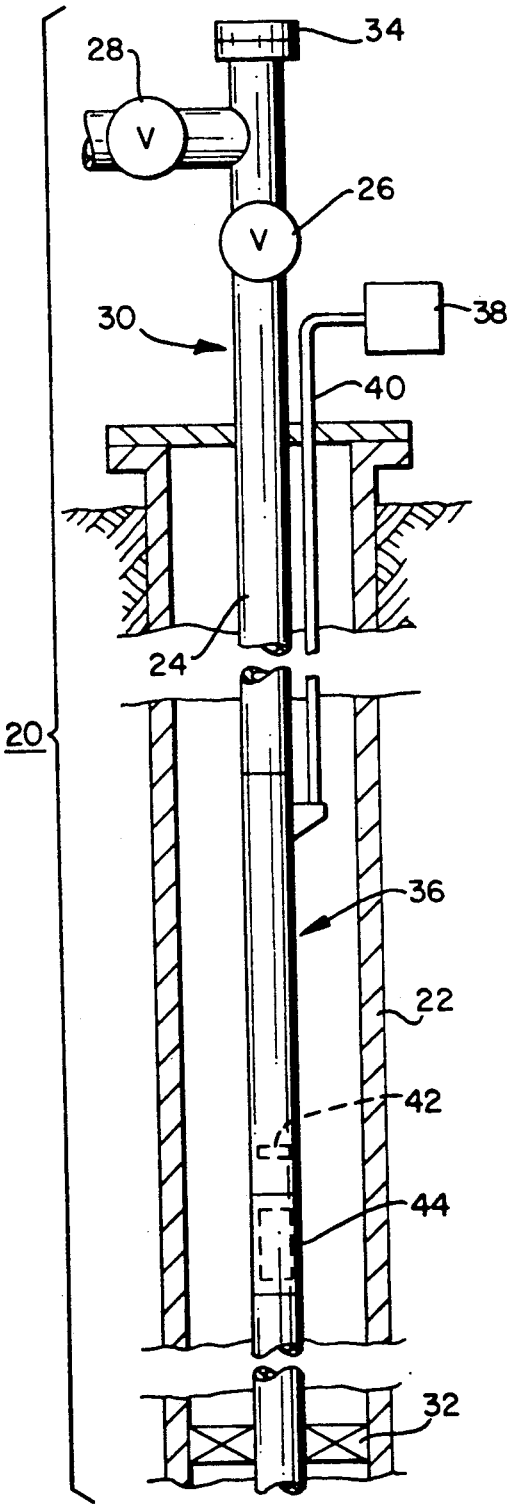
FIG. 1 is a schematic view in section and elevation of a typical well completion including a tubing retrievable subsurface safety valve.

Referring to FIG. 1, well completion 20 includes casing string 22 extending from the well surface to a hydrocarbon producing formation (not shown). Tubing string 24 is concentrically disposed within casing string 22 and extends from wellhead 30 through production packer 32, which seals off the annulus between tubing string 24 and casing 22. Production packer 32 directs formation fluids such as oil, gas, water, and the like, into tubing string 24 after they are admitted into the well bore through perforations (not shown) in casing 22. Flow control valves 26, 28 at the well surface control fluid flow from tubing string 24. Wellhead cap 34 is provided on wellhead 30 to permit servicing well 20 via tubing string 24 with wireline equipment.

Surface controlled subsurface safety valve 36 embodying the features of the invention is installed in well 20 as a part of tubing string 24 to control fluid flow to the well surface through tubing string 24 from downhole. Safety valve 36 is operated by control fluid conducted from hydraulic manifold 38 at the well surface through control line conduit 40 to safety valve 36. Hydraulic manifold 38 generally includes pumps, a fluid reservoir, accumulators, and control valves for the purpose of providing control fluid pressure signals for holding safety valve 36 open or allowing safety valve 36 to close when desired. Manifold 38 also includes apparatus which functions in response to temperature, surface line leaks, and other emergency conditions under which well 20 should be shut in. Temporary lockout sleeve 44 is provided in safety valve 36 for movement between a first position which holds valve closure means 42 open and a second position in which valve closure means 42 is free to open or close. With valve closure means 42 restrained in the open position by temporary lockout sleeve 44, various well servicing operations may be conducted without fear of inadvertent closure of safety valve 36, which can be damaging to the servicing equipment.

The construction, operation and method of use of a surface controlled subsurface safety valve in which the present invention can be employed is described and explained, for example, in U.S. Pat. No. 4,723,606, which is incorporated by reference herein. The improved lockout sleeve and lockout housing of the present invention are substituted for the "permanent lockout sleeve 80" and "cylinder 83", respectively, described in relation to FIG. 2A of U.S. Pat. No. 4,723,606, with the lugs and slots of the present invention being used in place of the threaded knockout plugs previously used.

Figure 2:
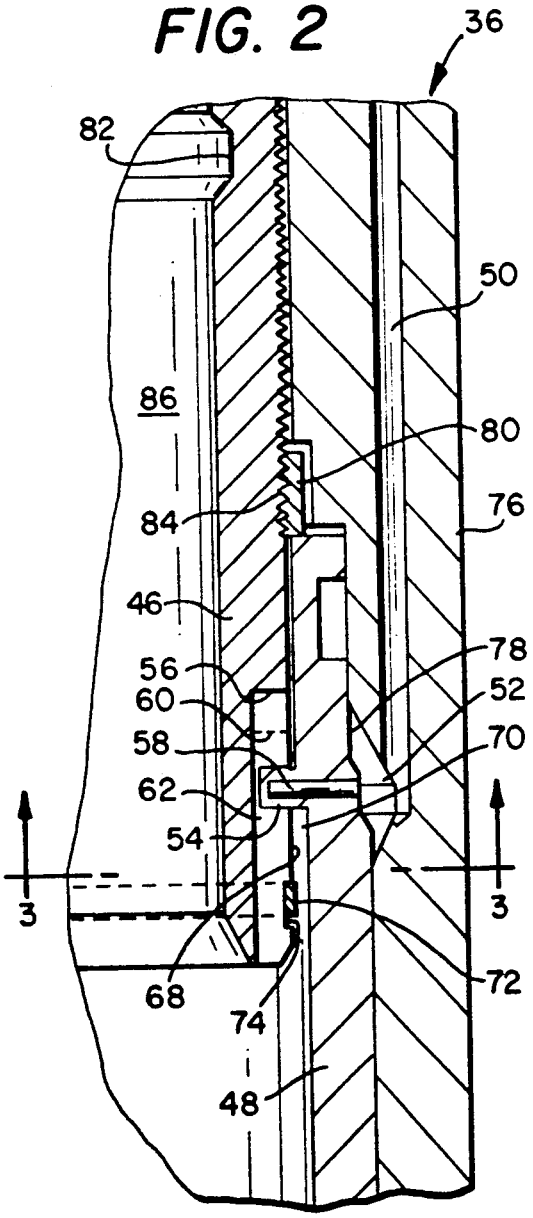
FIG. 2 is an enlarged detail sectional elevation view depicting those portions of the lockout housing and lockout sleeve of a surface controlled subsurface safety valve that embody the improvements of the present invention.
Figure 3:
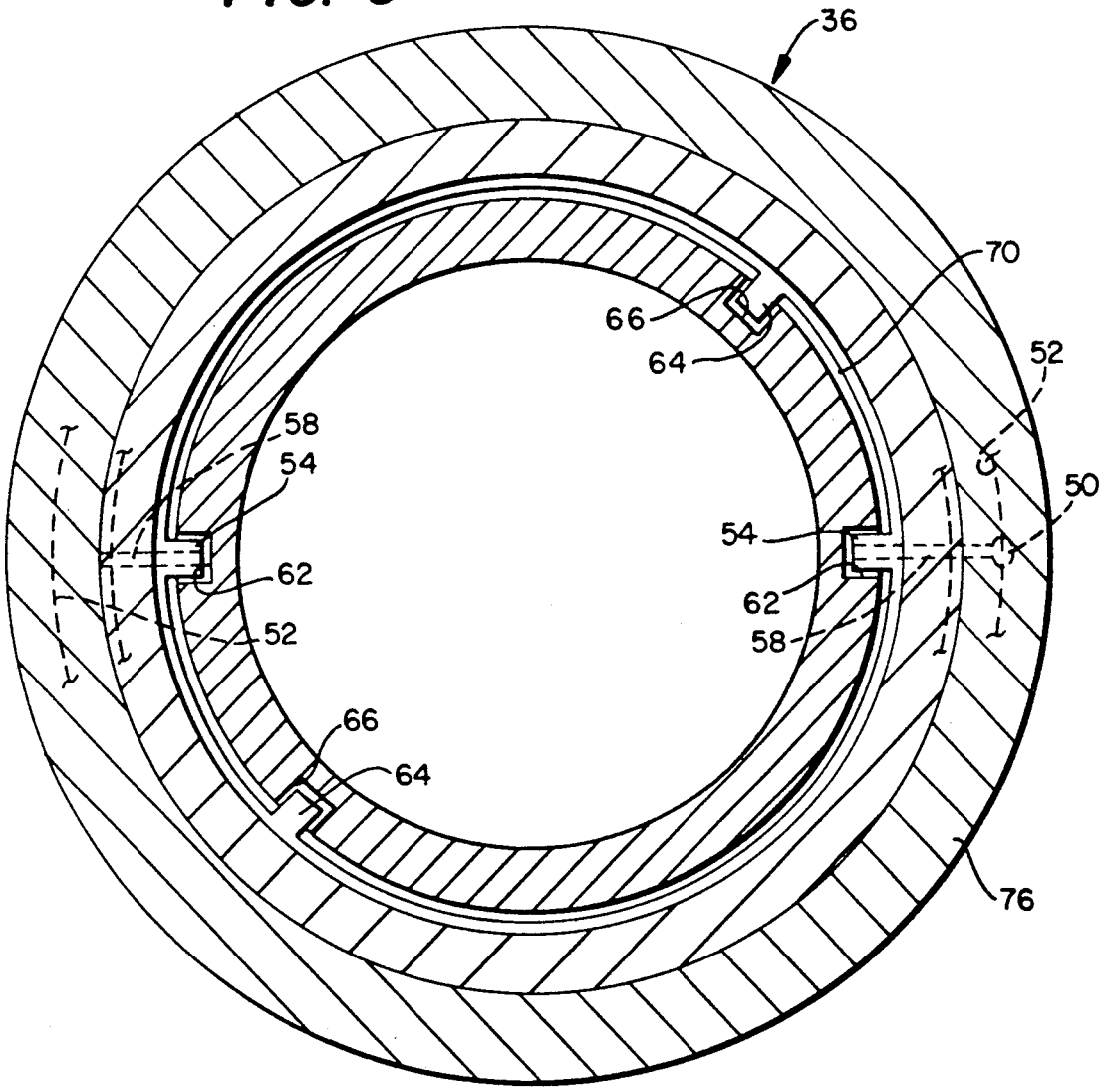
FIG. 3 is a cross-sectional plan view of the surface controlled subsurface safety valve of the invention taken along line 3—3 of FIG. 2.

The apparatus of the invention is further described in relation to FIGS. 2 and 3 herein. Referring to FIGS. 2 and 3, surface controlled subsurface safety valve 36 further comprises body 76 having lockout sleeve 46 and lockout housing 48 disposed therein. Near its upper end, lockout housing 48 preferably comprises at least one pair of circumferentially spaced retaining lugs 64 (visible in FIG. 3), and at least one pair of circumferentially spaced communicating lugs 54, that extend radially inward. Retaining lugs 64 and communicating lugs 54 are preferably unitarily formed as an integral part of lockout housing 48 by conventional machining methods.

According to a particularly preferred embodiment of the invention, each pair of retaining lugs 64 and communicating lugs 54 are diametrically opposed, and retaining lugs 64 are each circumferentially spaced apart from the nearest communicating lug 54 by an angle of less than 90 degrees to prevent misassembly of lockout housing 48 with lockout sleeve 46. Alternatively, retaining lugs 64 and communicating lugs 54 can be made with different widths to likewise prevent misassembly.

Communicating lugs 54 each preferably comprise a transverse bore 58 that extends radially inward from outside wall 78 of lockout housing 48, but that does not penetrate completely through communicating lugs 54. Transverse bore 58 of each communicating lug 54 communicates with circumferentially extending annulus 52, to which control line fluid is supplied from hydraulic manifold 38 (shown in FIG. 1) through bore 50 in body 76 of surface controlled subsurface safety valve 36.

Lockout sleeve 46 preferably comprises a plurality of pairs of circumferentially spaced, longitudinally extending slots 62, 66 near the lower end of outside wall 68 that are adapted to receive and provide sliding engagement with communicating lugs 54 and retaining lugs 64, respectively, of lockout housing 48. Slots 62, 66 preferably extend upwardly from the lower end of lockout sleeve 46, terminating at shoulders 56, 60, respectively. Slots 62 are preferably slightly longer than slots 66. Referring to FIG. 2, the longitudinal position of shoulders 60 of slots 66 relative to shoulders 56 of slots 62 is shown by a dashed line for illustrative purposes, although it is understood that slots 66 are circumferentially spaced apart from slots 62 so as to be longitudinally aligned with retaining lugs 64 and communicating lugs 54, respectively. Lockout sleeve 46 preferably further comprises annular recess 74 that extends around the lower end of outside wall 68 a sufficient distance below shoulders 56, 60 that communicating lugs 54 and retaining lugs 64 can extend radially into slots 62, 66 between annular recess 74 and shoulders 56, 60. Snap ring 72 is preferably disposed in annular recess 74, and extends transversely across slots 62, 66.

During regular operation, lockout sleeve 46 is maintained in its raised position relative to lockout housing 48 by snap ring 80 that engages teeth 84 on the upper portion of outside wall 68 of lockout sleeve 46. If lockout sleeve 46 is bumped downwardly by wireline tools passing through bore 86, shoulders 60 at the upper end of slots 66 will abut against retaining lugs 64. Because slots 62 are longer than slots 66, shoulders 56 of slots 62 do not contact communicating lugs 54 when shoulders 60 abut against retaining lugs 64. Retaining lugs 64 therefore protect and prevent premature cracking or shearing of communicating lugs 54 due to incidental contact or bumping of lockout sleeve 46 against lockout housing 48 before the time when it is desired to force lockout sleeve 46 downwardly into lockout housing 48.

To lock safety valve 36 open, lockout sleeve 46 must be forced downwardly into lockout housing 48. This cannot be done unless retaining lugs 64 and communicating lugs 54 are sheared. To lock safety valve 36 open, a conventional lockout tool (not shown) is run into bore 86 and set into profile 82. Sufficient downward pressure is then exerted on lockout sleeve 46 through the lockout tool that shoulders 60 first shear retaining lugs 64 from lockout housing 48. As retaining lugs 64 are sheared, the sheared portions are confined within slots 66 by snap ring 72, which is preferably sized so that the sheared portions cannot fall past it on either side. Once retaining lugs 64 have been sheared, lockout sleeve 46 drops to the point where shoulders 56 contact and shear communicating lugs 54, which are likewise confined in slots 62 by snap ring 72. Once communicating lugs 54 have been sheared, fluid communication is established between annulus 52 and annulus 70 through transverse bores 58.

In actual practice, retaining lugs 64 and communicating lugs 54 are sheared almost simultaneously because of the narrow longitudinal separation of shoulders 60, 56 relative to the speed and range of travel of the descending lockout sleeve 46. Significantly, however, the longitudinal spacing between shoulders 60, 56 is sufficient that retaining lugs 64 protect communicating lugs 54 from unintended, premature shearing prior to the time that retaining lugs 64 are sheared. After retaining lugs 64 and communicating lugs 54 are sheared, the piston (not shown) of safety valve 36 is forced down, opening the valve. A conventional expandable latch ring then prevents the valve's spring from forcing the valve back open.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

We claim:

1. Apparatus for use in a subsurface valve, said apparatus comprising:

a lockout housing comprising a substantially cylindrical sleeve and a plurality of circumferentially spaced lugs extending radially inward from the sleeve, the lugs being an integrally formed part of the cylindrical sleeve and comprising at least one pair of retaining lugs and at least one pair of communicating lugs; and a transverse bore extending radially inward through the sleeve and into but not through each of the communicating lugs; and a lockout sleeve concentrically aligned with and slidably engaging the inside of the cylindrical sleeve of the lockout housing; the lockout sleeve comprising a plurality of outwardly facing, circumferentially spaced, longitudinally extending slots, each slot having an upper and lower end, one slot being longitudinally aligned with and adapted to slidably engage each of the retaining lugs and communicating lugs of the lockout housing; the longitudinal distance between the communicating lugs and the upper ends of the slots aligned with the communicating lugs being greater than the longitudinal distance between the retaining lugs and the upper ends of the slots aligned with the retaining lugs.

2. The apparatus of claim 1 wherein each pair of retaining lugs are diametrically opposed.

3. The apparatus of claim 1 wherein each pair of communicating lugs are diametrically opposed.

4. The apparatus of claim 1, comprising one pair of diametrically opposed retaining lugs and one pair of diametrically opposed communicating lugs, with the circumferential spacing between each retaining lug and the nearest communicating lug being less than 90 degrees.

5. The apparatus of claim 1, further comprising means for confining sheared lug portions in the slots.

6. The apparatus of claim 5 wherein the lockout sleeve comprises an outwardly facing annular recess extending circumferentially around the lockout sleeve near the lower end of the slots.

7. The apparatus of claim 6 wherein a snap ring is disposed in the annular recess and traverses the slots.

8. Apparatus for use in a surface controlled subsurface safety valve, said apparatus comprising:

a lockout housing member comprising a substantially cylindrical sleeve; a plurality of circumferentially spaced, shearable, unitarily formed retaining lugs extending radially inward from the sleeve; a plurality of circumferentially spaced, shearable, unitarily formed communicating lugs extending radially inward from the sleeve, the communicating lugs being circumferentially spaced apart from the retaining lugs; and a transverse bore extending radially through the sleeve and into but not through each communicating lug;

a lockout sleeve member comprising an outside wall adapted to be slidably engaged inside the cylindrical sleeve of the lockout housing member and selectively moved between predetermined upper and lower positions relative to the lockout housing member; first and second sets of circumferentially spaced slots extending longitudinally upward around the outside wall, the first and second sets of longitudinally extending slots being longitudinally aligned with and adapted to receive the retaining lugs and communicating lugs, respectively, of the lockout housing when the lockout sleeve is slidably engaged in the upper position inside the cylindrical sleeve of the lockout housing, the second set of slots extending longitudinally farther upward than the first set of slots; each slot having a shoulder disposed at the upper end of the slot; means in said lockout sleeve member for communicating sufficient downward force through said lockout sleeve member and each shoulder to shear each retaining lug and each communicating lug from the lockout housing member; and means for confining each retaining lug and each communicating lug in its respective slot after being sheared from the lockout housing member.

9. The apparatus of claim 8 comprising diametrically opposed retaining lugs.

10. The apparatus of claim 8 comprising diametrically opposed communicating lugs.

11. The apparatus of claim 8 comprising one pair of diametrically opposed retaining lugs and one pair of diametrically opposed communicating lugs, with the circumferential spacing between each retaining lug and the nearest communicating lug being less than 90 degrees.

12. The apparatus of claim 8 wherein the means for confining each retaining lug and each communicating lug in its respective slot after being sheared from the lockout housing member comprises an annular recess in the outside wall of the lockout sleeve member and a snap ring disposed in the annular recess, the snap ring traversing each slot at a distance below the shoulder that is sufficient to confine a sheared lug therebetween.

13. Apparatus for use in a tubing retrievable safety valve, the apparatus comprising a lockout housing and a lockout sleeve adapted to be slidably engaged inside the lockout housing;

the lockout housing comprising a plurality of integrally formed, circumferentially spaced, inwardly facing lugs, at least one of which is solid and at least one of which comprises a transverse bore extending radially inward through the housing and into but not through the lug; and the lockout sleeve comprising a plurality of longitudinally extending, outwardly facing slots longitudinally aligned with the inwardly facing lugs of the lockout housing, each slot being adapted to slidably engage one lug, each slot having an upper end terminating in a shoulder adapted to abut the lug slidably engaged therewith when the lockout sleeve fully engages the lockout housing, the shoulder in each slot aligned with a solid lug being closer to the lug than the shoulder in each slot aligned with a lug comprising a transverse bore.

14. The apparatus of claim 13, comprising one pair of diametrically opposed retaining lugs and one pair of diametrically opposed communicating lugs, with the circumferential spacing between each retaining lug and the nearest communicating lug being less than 90 degrees.

15. The apparatus of claim 13 wherein the lockout sleeve further comprises an outwardly facing annular recess extending circumferentially around the lockout sleeve below the slidably engaged lugs.

16. The apparatus of claim 15 wherein a snap ring is disposed in the annular recess and traverses the slots.

* * * * *

UNITED STATES PATENT AND TRADEMARK OFFICE

CERTIFICATE OF CORRECTION

PATENT NO. : 5,127,476

DATED : JULY 7, 1992

INVENTOR(S) : RENNIE L. DICKSON ET AL

It is certified that error appears in the above-identified patent and that said Letters Patent is hereby corrected as shown below:

On the title page: please delete after Assignee: "Jerry Wilson" and insert -- Otis Engineering Corporation Carrollton, Texas --

Signed and Sealed this

Third Day of August, 1993

*Attest:*

Michael K. Kirk

MICHAEL K. KIRK

*Attesting Officer*

*Acting Commissioner of Patents and Trademarks*